US011279592B2

(12) United States Patent
Koide

(10) Patent No.: US 11,279,592 B2
(45) Date of Patent: Mar. 22, 2022

(54) ELEVATOR SYSTEM

(71) Applicant: Mitsubishi Electric Corporation, Chiyoda-ku (JP)

(72) Inventor: Kazuaki Koide, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 794 days.

(21) Appl. No.: 16/092,616

(22) PCT Filed: May 17, 2016

(86) PCT No.: PCT/JP2016/064581
§ 371 (c)(1),
(2) Date: Oct. 10, 2018

(87) PCT Pub. No.: WO2017/199329
PCT Pub. Date: Nov. 23, 2017

(65) Prior Publication Data

US 2019/0119069 A1 Apr. 25, 2019

(51) Int. Cl.
*B66B 1/48* (2006.01)
*B66B 5/00* (2006.01)
(Continued)

(52) U.S. Cl.
CPC ..... *B66B 5/06* (2013.01); *B66B 1/48* (2013.01); *B66B 5/022* (2013.01); *B66B 7/023* (2013.01)

(58) Field of Classification Search
CPC ..... B66B 5/0031; B66B 5/00; B66B 1/32; B66B 1/3492; B66B 5/0018; B66B 1/36;
(Continued)

(56) References Cited

U.S. PATENT DOCUMENTS

2007/0267254 A1* 11/2007 Bauge ..... B66B 9/02 187/316
2012/0024636 A1* 2/2012 Niikawa ..... B66B 5/02 187/391
(Continued)

FOREIGN PATENT DOCUMENTS

CN 102795521 A * 11/2012
EP 0985623 A2 * 3/2000
(Continued)

OTHER PUBLICATIONS

International Search Report dated Jul. 26, 2016, in PCT/JP2016/064581 filed May 17, 2016.

*Primary Examiner* — Marlon T Fletcher
(74) *Attorney, Agent, or Firm* — Oblon, McClelland, Maier & Neustadt, L.L.P.

(57) ABSTRACT

An elevator system is capable of detecting that a car has overshot a position where a limit switch operates. The elevator system includes: a limit switch; a conductive wire provided along a guide rail guiding movement of a counterweight; a contact being attached to the counterweight and moreover configured to come into contact with the conductive wire in a case where the counterweight is disconnected from the guide rail; an overshoot detection contact being attached to the conductive wire and disposed at a position that allows the overshoot detection contact to come into contact with the contact in the case where the car moves past a position where the limit switch operates; and an overshoot detection unit configured to detect that the contact is in contact with the overshoot detection contact.

4 Claims, 4 Drawing Sheets

(51) Int. Cl.
*B66B 5/06* (2006.01)
*B66B 5/02* (2006.01)
*B66B 7/02* (2006.01)

(58) Field of Classification Search
CPC ..... B66B 5/0068; B66B 1/40; B66B 1/48; B66B 5/06
See application file for complete search history.

(56) References Cited

U.S. PATENT DOCUMENTS

| | | | | |
|---|---|---|---|---|
| 2013/0133984 | A1* | 5/2013 | Osmanbasic | B66B 5/18 187/306 |
| 2019/0119069 | A1* | 4/2019 | Koide | B66B 5/06 |

FOREIGN PATENT DOCUMENTS

| | | | |
|---|---|---|---|
| EP | 1151953 | A1 * | 11/2001 |
| FR | 2977881 | A1 * | 1/2013 |
| JP | 5-262473 | A | 10/1993 |
| WO | WO 2011/010376 | A1 | 1/2011 |
| WO | WO-2011001764 | A1 * | 1/2011 |
| WO | WO-2013035376 | A1 * | 3/2013 |
| WO | WO-2016062686 | A1 * | 4/2016 |

* cited by examiner

ELEVATOR SYSTEM

TECHNICAL FIELD

The present invention relates to an elevator system.

BACKGROUND ART

PTL 1 shown below describes a safety device of an elevator. The safety device includes a limit switch that is provided in each of the upper portion and the lower portion of a hoistway. The limit switch operates in the case where a car overshoots a terminal floor.

CITATION LIST

Patent Literature

[PTL 1] Japanese Patent Application Publication No. H05-262473

SUMMARY OF INVENTION

Technical Problem

The safety device described in PTL 1 cannot detect that the car has overshot a position where the limit switch operates.

The present invention has been made in order to solve the above problem. An object thereof is to provide an elevator system capable of detecting that a car has overshot a position where a limit switch operates.

Solution to Problem

The elevator system according to the present invention is an elevator system including: a limit switch provided in an upper portion or a lower portion of a hoistway, the limit switch configured to operate in a case where a car overshoots a terminal floor; a conductive wire provided along a guide rail guiding movement of a counterweight; a contact having conductivity and being attached to the counterweight, the contact configured to come into contact with the conductive wire in a case where the counterweight is disconnected from the guide rail; an overshoot detection contact having conductivity and being attached to the conductive wire in the upper portion or the lower portion of the hoistway on a side opposite to the limit switch, the overshoot detection contact being disposed at a position that allows the overshoot detection contact to come into contact with the contact in a case where the car moves past a position where the limit switch operates; and an overshoot detection unit provided in a control panel electrically connected to the conductive wire, the overshoot detection unit configured to detect that the contact is in contact with the overshoot detection contact.

Advantageous Effects of Invention

In the elevator system according to the present invention, the overshoot detection contact is disposed at the position that allows the overshoot detection contact to come into contact with the contact in the case where the car moves past the position where the limit switch operates. The overshoot detection unit detects the contact of the contact with the overshoot detection contact. Consequently, according to the present invention, it is possible to detect that the car has overshot the position where the limit switch operates.

DESCRIPTION OF EMBODIMENT

Figure 1:
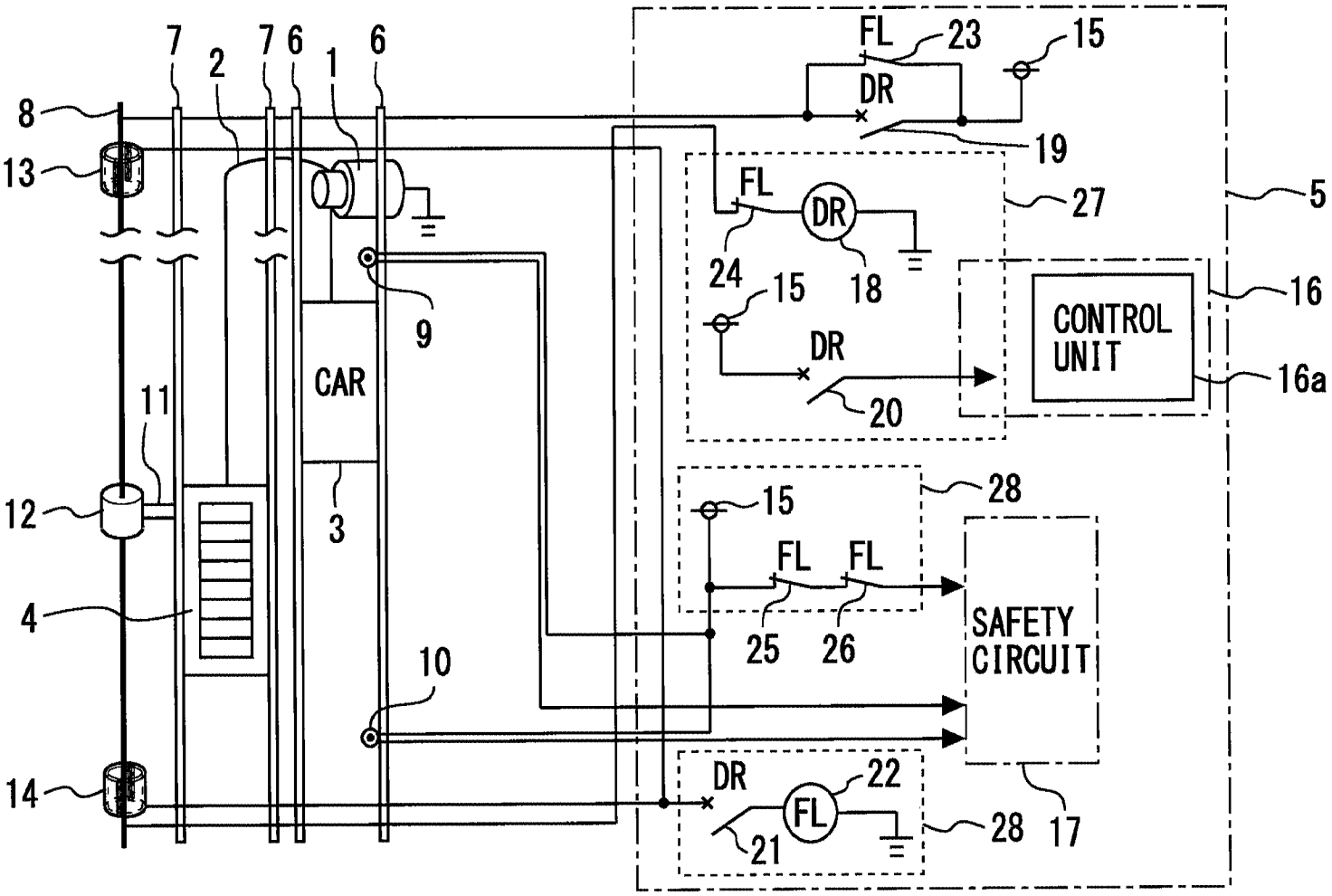
FIG. 1 is a configuration diagram showing an example of an elevator system in Embodiment 1 of the present invention.

The present invention will be described in detail with reference to the accompanying drawings. In the drawings, the same or corresponding parts are designated by the same reference numerals. The repeated description thereof will be appropriately simplified or omitted.

Embodiment 1

FIG. 1 is a configuration diagram showing an example of an elevator system in Embodiment 1.

As shown in FIG. 1, the elevator system includes a hoist 1, a main rope 2, a car 3, a counterweight 4, and a control panel 5. The main rope 2 is wound around the hoist 1. The car 3 and the counterweight 4 are hung in a hoistway that is not shown by the main rope 2. The hoistway is formed so as to pass through, for example, the individual floors of a building that is not shown. Each of the car 3 and the counterweight 4 serving as elevating bodies of an elevator moves up and down by driving the hoist 1. The control panel 5 has the function of controlling the hoist 1.

A pair of car guide rails 6, a pair of weight guide rails 7, and a conductive wire 8 are provided in the hoistway. The car guide rails 6 and the weight guide rails 7 are provided, for example, vertically. The car guide rails 6 guide upward and downward movement of the car 3. The weight guide rails 7 guide upward and downward movement of the counterweight 4. The conductive wire 8 is provided in parallel along the longitudinal direction of the weight guide rail 7.

A limit switch is attached to the car guide rail 6. The limit switch is provided in each of the upper portion and the lower portion of the hoistway. The limit switch is disposed in the vicinity of each terminal floor. The limit switch includes an upper limit switch 9 and a lower limit switch 10. In the upper portion of the hoistway, the upper limit switch 9 is disposed at a position that allows the upper limit switch 9 to operate in the case where the car 3 overshoots the top floor. In the lower portion of the hoistway, the lower limit switch 10 is disposed at a position that allows the lower limit switch 10 to operate in the case where the car 3 overshoots the bottom floor. The limit switches are electrically connected to the control panel 5.

A contact 12 is attached to the frame of the counterweight 4 via a support 11. The contact 12 is formed, for example, tubularly. Each of the upper surface and the lower surface of the contact 12 is formed, for example, horizontally. The contact 12 is provided so as to surround the conductive wire 8 when viewed in a vertical direction. That is, the conductive wire 8 passes through the contact 12. In a usual state, the contact 12 is disposed at a position that prevents the contact 12 from coming into contact with the conductive wire 8. The contact 12 is disposed at a position that allows the contact 12 to come into contact with the conductive wire 8 in the case where the counterweight 4 is disconnected from the weight guide rails 7. The shape of the contact 12 when viewed in the vertical direction may be circular or polygonal.

At least the surface of each of the main rope 2, the frame of the counterweight 4, the conductive wire 8, the support 11, and the contact 12 is formed of a material having conductivity. That is, the contact 12 is electrically connected to the hoist 1 via the support 11, the frame of the counterweight 4, and the main rope 2.

An overshoot detection contact is attached to the conductive wire 8. The overshoot detection contact is formed into, for example, a tubular shape similar to the shape of the contact 12. The overshoot detection contact includes an upper overshoot detection contact 13 and a lower overshoot detection contact 14. The upper overshoot detection contact 13 is disposed above the upper limit switch 9 in the hoistway. The upper overshoot detection contact 13 is disposed above the contact 12 when the car 3 is stopped at the bottom floor. The lower overshoot detection contact 14 is disposed below the lower limit switch 10 in the hoistway. The lower overshoot detection contact 14 is disposed below the contact 12 when the car 3 is stopped at the top floor.

The conductive wire 8 is electrically connected to the control panel 5. The conductive wire 8 is electrically connected to the control panel 5 such that an area through which the contact 12 can pass is energized from the control panel 5. Examples of the position of connection with the control panel 5 in the conductive wire 8 include a position above the upper overshoot detection contact 13, and a position below the lower overshoot detection contact 14.

Figure 2:
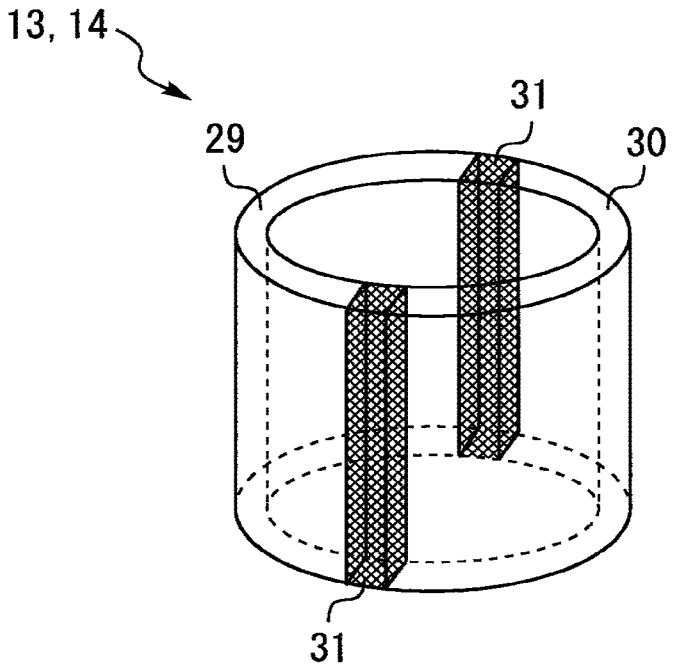
FIG. 2 is a perspective view showing an example of an overshoot detection contact in Embodiment 1 of the present invention.

FIG. 2 is a perspective view showing an example of the overshoot detection contact in Embodiment 1.

As shown in FIG. 2, the overshoot detection contact has a first conductive portion 29, a second conductive portion 30, and insulating portions 31. Each of the first conductive portion 29 and the second conductive portion 30 is formed of a material having conductivity. Each insulating portion 31 is an insulator that separates the first conductive portion 29 from the second conductive portion 30. The insulating portion 31 is disposed along, for example, a plane that laterally halves the overshoot detection contact. Each of the upper surface and the lower surface of the overshoot detection contact is formed, for example, horizontally. That is, when the contact 12 comes into contact with the overshoot detection contact from above or below, the contact 12 comes into contact with both of the first conductive portion 29 and the second conductive portion 30 simultaneously.

In a state shown in FIG. 1, the first conductive portion 29 is fixed so as to be in contact with the conductive wire 8. In the state shown in FIG. 1, the second conductive portion 30 is electrically connected to the control panel 5 without being in contact with the conductive wire 8. That is, the first conductive portion 29 is not electrically connected to the second conductive portion 30 except when the intervention of another material having conductivity is provided.

As shown in FIG. 1, the control panel 5 has a power supply device 15, an input/output board 16, and a safety circuit 17. The input/output board 16 has a control unit 16*a*.

As shown in FIG. 1, the control panel 5 has a relay DR and a relay FL. The relay DR has a coil 18, a make contact 19, a make contact 20, and a make contact 21. The relay FL has a coil 22, a break contact 23, a break contact 24, a break contact 25, and a break contact 26. The make contact 19 of the relay DR and the break contact 23 of the relay FL are provided between the power supply device 15 and the conductive wire 8.

As shown in FIG. 1, the control panel 5 has a derailment detection unit 27 and an overshoot detection unit 28. The derailment detection unit 27 includes the coil 18 of the relay DR, the make contact 20 of the relay DR, the break contact 24 of the relay FL, and the portion of the input/output board 16 that receives a signal. The overshoot detection unit 28 includes the make contact 21 of the relay DR, the coil 22 of the relay FL, the break contact 25 of the relay FL, and the break contact 26 of the relay FL.

In the elevator system shown in FIG. 1, parts corresponding to the power supply device 15, the conductive wire 8, the contact 12, the support 11, the counterweight 4, the main rope 2, the hoist 1, and the derailment detection unit 27 function as a derailment detection circuit.

In the case where the elevator is operated normally, the break contact 23 of the relay FL is closed, and hence the conductive wire 8 is energized. In this case, voltage is applied to the coil 18 of the relay DR, and hence the make contact 19, the make contact 20, and the make contact 21 are closed. When the make contact 20 is closed, a derailment detection signal DR is input to the input/output board 16. Hereinafter, inputting of the derailment detection signal DR to the input/output board 16 is also expressed as "the derailment detection signal DR is detected by the derailment detection unit 27".

When the contact 12 is caused to come into contact with the conductive wire 8 by the derailment of the counterweight 4, current is caused to flow through the hoist 1 from the power supply device 15 via the conductive wire 8, the contact 12, the support 11, the frame of the counterweight 4, and the main rope 2. That is, when the contact 12 comes into contact with the conductive wire 8, a ground fault occurs. In this case, the power supply device 15 stops power supply to the derailment detection circuit by operating an overcurrent protection function. With this, the application of voltage to the coil 18 of the relay DR is suspended, and hence the make contact 20 is opened. That is, when electrical conduction between the conductive wire 8 and the contact 12 is provided, the detection of the derailment detection signal DR by the derailment detection unit 27 is suspended. Thus, the derailment detection unit 27 detects the derailment of the counterweight 4 based on the suspension of the detection of the derailment detection signal DR.

When the detection of the derailment detection signal DR by the derailment detection unit 27 is suspended, the control unit 16*a* quickly stops the car 3. That is, when the electrical conduction between the conductive wire 8 and the contact 12 is detected, the control unit 16*a* quickly stops the car 3. Hereinafter, stopping of the car 3 based on the detection of the electrical conduction between the conductive wire 8 and the contact 12 by the derailment detection unit 27 is also referred to as a "first stop operation".

As shown in FIG. 1, the upper limit switch 9 is electrically connected to the power supply device 15 and the safety circuit 17. The lower limit switch 10 is electrically connected to the power supply device 15 and the safety circuit 17. The limit switch operates by coming into contact with, for example, a cam provided on the side surface of the car 3. In a state in which the limit switch does not operate, an electrical signal is input to the safety circuit 17 from the limit switch. When the limit switch operates, inputting of the electrical signal to the safety circuit 17 from the limit switch is suspended. When the inputting of the electrical signal to the safety circuit 17 from any limit switch is suspended, the control unit 16*a* reduces the speed of the car 3. That is, the control unit 16*a* reduces the speed of the car 3 in the case where the car 3 overshoots the terminal floor.

As shown in FIG. 1, the upper overshoot detection contact 13 and the lower overshoot detection contact 14 are electrically connected to the overshoot detection unit 28. In the case where the elevator is operated normally, the contact 12 does not come into contact with the overshoot detection contact. In addition, even when the limit switch operates, the contact 12 does not come into contact with the overshoot detection contact. When the contact 12 is not in contact with the overshoot detection contact, the first conductive portion 29 is energized, and the second conductive portion 30 is not energized. When the second conductive portion 30 is not energized, voltage is not applied to the coil 22 of the relay FL, and hence the break contact 25 and the break contact 26 are closed. That is, when the contact 12 is not in contact with the overshoot detection contact, an electrical signal is input to the safety circuit 17 from the break contact 25 and the break contact 26. Hereinafter, inputting of the electrical signal to the safety circuit 17 from the break contact 25 and the break contact 26 is also expressed as "the electrical signal is detected by the overshoot detection unit 28".

In the case where the car 3 continues to ascend past the position where the upper limit switch 9 operates, the contact 12 comes into contact with the lower overshoot detection contact 14. In the case where the car 3 continues to descend past the position where the lower limit switch 10 operates, the contact 12 comes into contact with the upper overshoot detection contact 13. When the contact 12 comes into contact with the overshoot detection contact, the first conductive portion 29 and the second conductive portion 30 are electrically connected to each other via the contact 12. When the first conductive portion 29 and the second conductive portion 30 are electrically connected to each other, voltage is applied to the coil 22 of the relay FL, and hence the break contact 25 and the break contact 26 are opened. That is, when the contact 12 and the overshoot detection contact come into contact with each other, the detection of the electrical signal by the overshoot detection unit 28 is suspended. Thus, the overshoot detection unit 28 detects that the car 3 has overshot the position where the limit switch operates based on the suspension of the detection of the electrical signal by the overshoot detection unit 28.

When the detection of the electrical signal by the overshoot detection unit 28 is suspended, the control unit 16*a* quickly stops the car 3. That is, when the contact between the contact 12 and the overshoot detection contact is detected, the control unit 16*a* quickly stops the car 3. Hereinafter, stopping of the car 3 based on the detection of the contact of the contact 12 with the overshoot detection contact by the overshoot detection unit 28 is also referred to as a "second stop operation".

Note that, when the contact 12 comes into contact with the overshoot detection contact, current is caused to flow through the hoist 1 from the power supply device 15 via the conductive wire 8, the first conductive portion 29, the contact 12, the support 11, the frame of the counterweight 4, and the main rope 2. That is, an energization state similar to that in the case where the derailment of the counterweight 4 has occurred is artificially created. Consequently, in the case where the contact 12 comes into contact with the overshoot detection contact, not only the "second stop operation" but also the "first stop operation" is executed.

Figure 3:
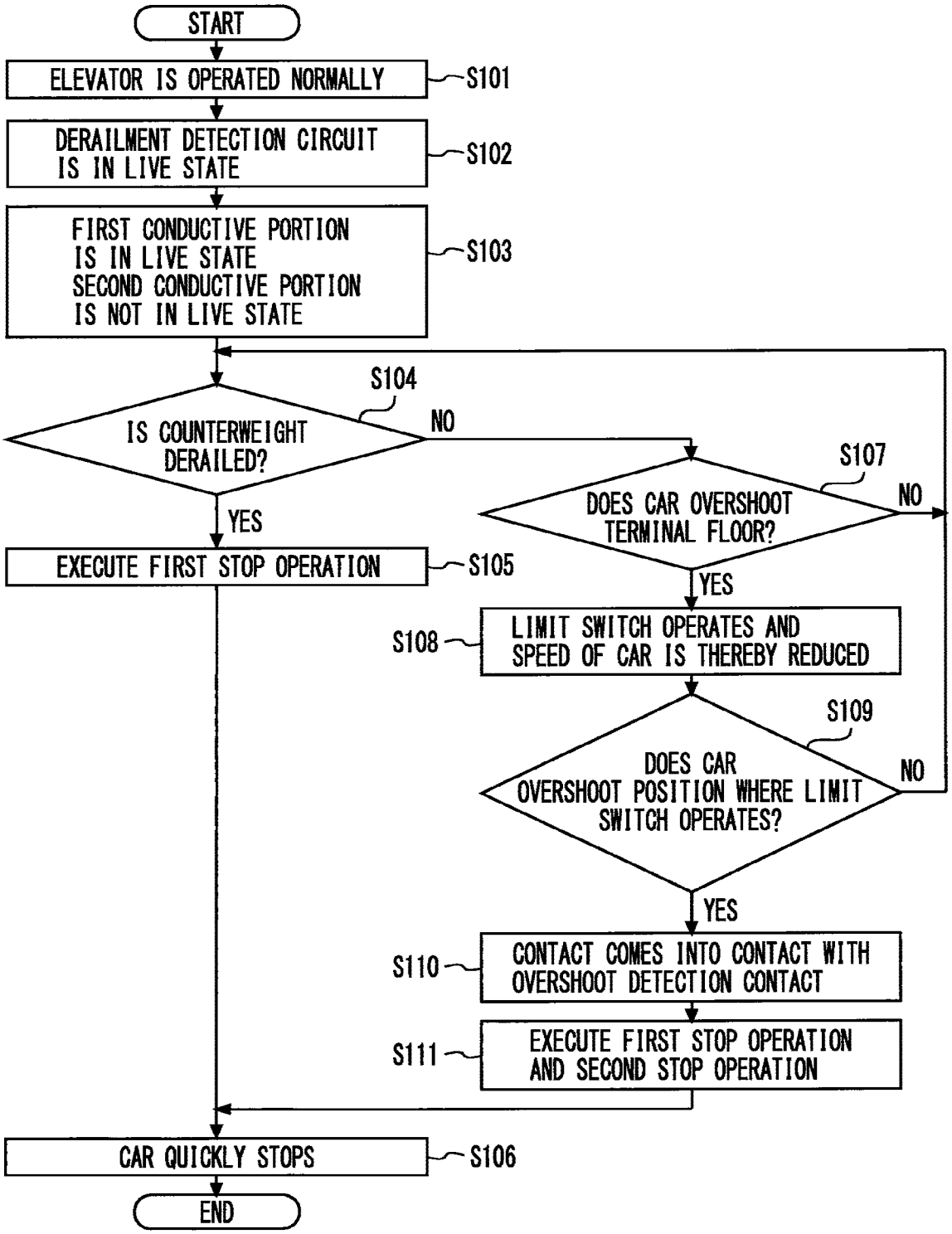
FIG. 3 is a flowchart showing an example of the operation of the elevator system in Embodiment 1 of the present invention.

FIG. 3 is a flowchart showing an example of the operation of the elevator system in Embodiment 1.

When the elevator is operated normally (Step S101), the derailment detection circuit is in a live state (Step S102). When the elevator is operated normally, the first conductive portion 29 of the overshoot detection contact is in the live state, and the second conductive portion 30 is not in the live state (Step S103).

The operation of the elevator system differs according to whether or not the counterweight 4 is derailed (Step S104). In the case where the counterweight 4 is derailed in Step S104, the control unit 16*a* executes the first stop operation (Step S105). With the process in Step S105, the car 3 quickly stops (Step S106).

In the case where the counterweight 4 is not derailed in Step S104, the operation of the elevator system differs according to whether or not the car 3 overshoots the terminal floor (Step S107). In the case where the car 3 does not overshoot the terminal floor in Step S107, the determination in Step S104 is performed.

In the case where the car 3 has overshot the terminal floor in Step S107, the limit switch operates and the speed of the car 3 is thereby reduced (Step S108). The operation after Step S108 differs according to whether or not the car 3 overshoots the position where the limit switch operates (Step S109). In the case where the car 3 does not overshoot the position where the limit switch operates in Step S109, the determination in Step S104 is performed.

In the case where the car 3 has overshot the position where the limit switch operates in Step S109, the contact 12 comes into contact with the overshoot detection contact (Step S110). In this case, the control unit 16*a* executes the first stop operation and the second stop operation (Step S111). With the process in Step S111, the car 3 quickly stops (S106).

In Embodiment 1, one of the limit switches is provided in the upper portion or the lower portion of the hoistway. The limit switch operates in the case where the car 3 overshoots the terminal floor. The conductive wire 8 is provided along the guide rails for guiding the movement of the counterweight 4. The contact 12 attached to the counterweight 4 is disposed at the position that allows the contact 12 to come into contact with the conductive wire 8 in the case where the counterweight 4 is disconnected from the guide rails. One of the overshoot detection contacts is attached to the conductive wire 8 in the upper portion or the lower position of the hoistway on a side opposite to the above limit switch. The overshoot detection contact is disposed at the position that prevents the overshoot detection contact from coming into contact with the contact 12 when the limit switch operates, and allows the overshoot detection contact to come into contact with the contact 12 in the case where the car 3 moves past the position where the limit switch operates. The overshoot detection unit 28 detects the contact of the contact 12 with the overshoot detection contact. Consequently, according to Embodiment 1, it is possible to detect that the car has overshot the position where the limit switch operates.

In Embodiment 1, the first conductive portion 29 of the overshoot detection contact is in contact with the conductive wire 8. The second conductive portion 30 of the overshoot detection contact is connected to the overshoot detection unit 28 without being in contact with the conductive wire 8. The insulating portions 31 of the overshoot detection contact separate the first conductive portion 29 from the second conductive portion 30. The overshoot detection contact is formed into a shape that allows both of the first conductive portion 29 and the second conductive portion 30 to come into contact with the contact 12 simultaneously in the case where the car 3 moves past the position where the limit switch operates. That is, the overshoot detection contact is formed so as to electrically connect the conductive wire 8 and the overshoot detection unit 28 to each other only in the case where the overshoot detection contact comes into contact with the contact 12. Consequently, according to Embodiment 1, it is possible to detect that the car has overshot the position where the limit switch operates.

In Embodiment 1, the derailment detection unit 27 detects the electrical conduction between the conductive wire 8 and the contact 12. The control panel 5 performs the first stop operation that stops the car 3 based on the detection of the electrical conduction between the conductive wire 8 and the contact 12 by the derailment detection unit 27. The control panel 5 performs the second stop operation that stops the car based on the detection of the contact of the contact 12 with the overshoot detection contact by the overshoot detection unit 28. That is, in the case where the contact 12 comes into contact with the overshoot detection contact, the control panel 5 performs both of the first stop operation and the second stop operation. Consequently, according to Embodiment 1, in the case where the car overshoots the position where the limit switch operates, it is possible to cause the derailment detection circuit to function as fault tolerance.

In Embodiment 1, the conductive wire 8, the contact 12, the upper overshoot detection contact 13, and the lower overshoot detection contact 14 may be provided for each weight guide rail 7. That is, for example, two conductive wires 8, two contacts 12, two upper overshoot detection contacts 13, and two lower overshoot detection contacts 14 may be provided. In this case as well, it is possible to detect the overshoot of the car by the same method.

Figure 4:
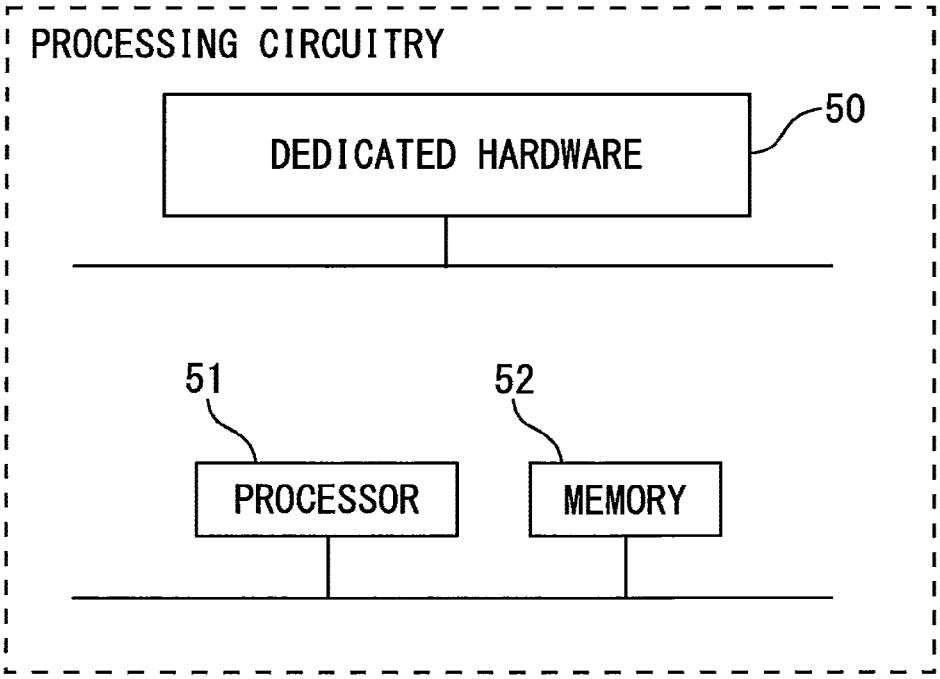
FIG. 4 is a hardware configuration diagram of a control panel.

FIG. 4 is a hardware configuration diagram of the control panel.

The individual functions of the control unit 16*a* and the safety circuit 17 in the control panel 5 are implemented by processing circuitry. The processing circuitry may be dedicated hardware 50. The processing circuitry may include a processor 51 and a memory 52. Part of the processing circuitry may be formed as the dedicated hardware 50, and the processing circuitry may further include the processor 51 and the memory 52. FIG. 4 shows an example in the case where part of the processing circuitry is formed as the dedicated hardware 50, and the processing circuitry includes the processor 51 and the memory 52.

In the case where at least part of the processing circuitry is at least one dedicated hardware 50, the processing circuitry corresponds to, for example, a single circuit, a composite circuit, a programmed processor, a parallel-programmed processor, an ASIC, an FPGA, or a combination thereof.

In the case where the processing circuitry includes at least one processor 51 and at least one memory 52, the individual functions of the control unit 16*a* and the safety circuit 17 are implemented by software, firmware, or a combination of software and firmware. The software and the firmware are described as programs, and the programs are stored in the memory 52. The processor 51 implements the functions of the individual units by reading and executing the programs stored in the memory 52. The processor 51 is also referred to as a CPU (Central Processing Unit), a central processor, a processing unit, an arithmetic unit, a microprocessor, a microcomputer, or a DSP. The memory 52 corresponds to, for example, a non-volatile or volatile semiconductor memory such as a RAM, a ROM, a flash memory, an EPROM, or an EEPROM, a magnetic disk, a flexible disk, an optical disk, a compact disc, a minidisc, or a DVD.

Thus, the processing circuitry can implement the individual functions of the control panel 5 by the hardware, the software, the firmware, or the combination thereof.

INDUSTRIAL APPLICABILITY

Thus, the present invention can be applied to the elevator.

REFERENCE SIGNS LIST

1 Hoist
2 Main rope
3 Car
4 Counterweight
5 Control panel
6 Car guide rail
7 Weight guide rail
8 Conductive wire
9 Upper limit switch
10 Lower limit switch
11 Support
12 Contact
13 Upper overshoot detection contact
14 Lower overshoot detection contact
15 Power supply device
16 Input/output board
16*a* Control unit
17 Safety circuit
18 Coil
19 Make contact
20 Make contact
21 Make contact
22 Coil
23 Break contact
24 Break contact
25 Break contact
26 Break contact
27 Derailment detection unit
28 Overshoot detection unit
29 First conductive portion
30 Second conductive portion
31 Insulating portion
50 Dedicated hardware
51 Processor
52 Memory

The invention claimed is:

1. An elevator system comprising:

a limit switch provided in an upper portion or a lower portion of a hoistway, the limit switch configured to operate in a case where a car overshoots a terminal floor;

a conductive wire provided along a guide rail guiding movement of a counterweight;

a contact having conductivity and being attached to the counterweight, the contact configured to come into contact with the conductive wire in a case where the counterweight is disconnected from the guide rail;

an overshoot detection contact having conductivity and being attached to the conductive wire in the upper portion or the lower portion of the hoistway on a side opposite to the limit switch, the overshoot detection contact being disposed at a position that allows the overshoot detection contact to come into contact with the contact in a case where the car moves past a position where the limit switch operates; and an overshoot detection unit provided in a control panel electrically connected to the conductive wire, the overshoot detection unit configured to detect that the contact is in contact with the overshoot detection contact.

2. The elevator system according to claim 1, wherein the overshoot detection contact has:

a first conductive portion in contact with the conductive wire;

a second conductive portion connected to the overshoot detection unit without being in contact with the conductive wire; and an insulating portion separating the first conductive portion from the second conductive portion, and the overshoot detection contact is formed into a shape that allows both of the first conductive portion and the second conductive portion to come into contact with the contact in the case where the car moves past the position where the limit switch operates.

3. The elevator system according to claim 1, further comprising:

a derailment detection unit provided in the control panel, the derailment detection unit configured to detect electrical conduction between the conductive wire and the contact, wherein the control panel performs a first stop operation that stops the car on the basis of the detection of the electrical conduction between the conductive wire and the contact by the derailment detection unit, and a second stop operation that stops the car on the basis of the detection that the contact is in contact with the overshoot detection contact by the overshoot detection unit.

4. The elevator system according to claim 2, further comprising:

a derailment detection unit provided in the control panel, the derailment detection unit configured to detect electrical conduction between the conductive wire and the contact, wherein the control panel performs a first stop operation that stops the car on the basis of the detection of the electrical conduction between the conductive wire and the contact by the derailment detection unit, and a second stop operation that stops the car on the basis of the detection that the contact is in contact with the overshoot detection contact by the overshoot detection unit.

* * * * *